US009796545B2

(12) United States Patent
Morizono et al.

(10) Patent No.: US 9,796,545 B2
(45) Date of Patent: Oct. 24, 2017

(54) SHEET CONVEYING DEVICE AND IMAGE FORMING APPARATUS INCLUDING SHEET CONVEYING DEVICE

(71) Applicant: KYOCERA Document Solutions Inc., Osaka-shi, Osaka (JP)

(72) Inventors: Koki Morizono, Osaka (JP); Yoshiaki Tashiro, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/085,275

(22) Filed: Mar. 30, 2016

(65) Prior Publication Data

US 2016/0289024 A1 Oct. 6, 2016

(30) Foreign Application Priority Data

Apr. 3, 2015 (JP) ..... 2015-076763

(51) Int. Cl.
*B65H 5/06* (2006.01)
*B65H 5/36* (2006.01)
*B65H 5/38* (2006.01)

(52) U.S. Cl.
CPC ..... *B65H 5/062* (2013.01); *B65H 5/36* (2013.01); *B65H 5/38* (2013.01); (Continued)

(58) Field of Classification Search
CPC ..... B65H 5/06; B65H 5/062; B65H 2301/44318; B65H 2402/52; B65H 2402/521; B65H 2402/5211; B65H 2402/522; B65H 2402/5221; B65H 2402/52211; B65H 2404/1341; B65H 2404/1342; B65H 2404/13421; (Continued)

(56) References Cited

U.S. PATENT DOCUMENTS 5,738,452 A * 4/1998 Uchida ..... B41J 11/58 271/121
7,080,836 B2 * 7/2006 Hamada ..... B65H 5/062 271/272
7,669,849 B2 * 3/2010 Liu ..... B65H 5/06 271/272
7,819,396 B2 * 10/2010 Kuo ..... B65H 3/5269 271/104

(Continued)

FOREIGN PATENT DOCUMENTS

JP 11020981 A 1/1999

*Primary Examiner* — Ernesto Suarez
(74) *Attorney, Agent, or Firm* — Alleman Hall Creasman & Tuttle LLP

(57) ABSTRACT

A sheet conveying device includes a first conveyance roller, a sheet conveyance path, a second conveyance roller, and a pair of bearing portions. The first conveyance roller is provided in an apparatus main body. The sheet conveyance path has a guide surface that guides a sheet member in a sheet conveyance direction. The second conveyance roller is rotatably attached to the guide surface via a shaft and abuts on the first conveyance roller by a predetermined pressing force. The bearing portions are provided on the guide surface and support the shaft. Each bearing portion includes a concave groove portion and a bush member. The concave groove portion is formed on the guide surface such that a groove depth direction is perpendicular to the guide surface. The bush member is attached to the concave groove portion so as to be slidable in the groove depth direction and support the shaft.

8 Claims, 10 Drawing Sheets

(52) U.S. Cl.
CPC ..... *B65H 2301/44318* (2013.01); *B65H 2402/441* (2013.01); *B65H 2402/5152* (2013.01); *B65H 2402/5221* (2013.01); *B65H 2404/133* (2013.01); *B65H 2404/1341* (2013.01); *B65H 2404/144* (2013.01); *B65H 2404/174* (2013.01); *B65H 2404/513* (2013.01); *B65H 2404/54* (2013.01); *B65H 2404/611* (2013.01)

(58) Field of Classification Search
CPC ..... B65H 2404/143; B65H 2404/1431; B65H 2404/144; B65H 2404/17
USPC ..... 271/274
See application file for complete search history.

(56) References Cited

U.S. PATENT DOCUMENTS

| | | | | |
|---|---|---|---|---|
| 8,807,562 | B2 * | 8/2014 | Yamaguchi | B41J 13/00 271/273 |
| 8,840,110 | B2 * | 9/2014 | Tamura | B65H 5/062 271/272 |
| 8,876,111 | B1 * | 11/2014 | Lan | B65H 5/06 271/273 |
| 2004/0178571 | A1 * | 9/2004 | Ohama | B65H 29/14 271/272 |
| 2006/0237895 | A1 * | 10/2006 | Nishikata | B65H 3/0669 271/121 |

* cited by examiner

SHEET CONVEYING DEVICE AND IMAGE FORMING APPARATUS INCLUDING SHEET CONVEYING DEVICE

INCORPORATION BY REFERENCE

This application is based upon and claims the benefit of priority from the corresponding Japanese Patent Application No. 2015-076763 filed on Apr. 3, 2015, the entire contents of which are incorporated herein by reference.

BACKGROUND

The present disclosure relates to a sheet conveying device in which a conveyance roller is attached to a conveyance guide member that has a guide surface of a conveyance path, and in particular relates to a mechanism for supporting a shaft of the conveyance roller.

A conventional image forming apparatus such as a copier or a printer includes a sheet conveying device for conveying a sheet member (print sheet). The sheet conveying device includes a conveyance roller for conveying the sheet member. A rotational driving force is transmitted to the conveyance roller from a motor or the like, thereby the sheet member is conveyed along a conveyance path formed inside the image forming apparatus. As one example of this kind of image forming apparatus, there is known an image forming apparatus in which a conveyance guide member having a guide surface of the conveyance path is provided, and the conveyance roller is supported by the conveyance guide member. In addition, as another example of the image forming apparatus, there is known a support mechanism in which a conveyance guide member is attached to a frame of an apparatus main body in an openable/closable manner, and a conveyance roller is supported by the conveyance guide member. According to this support mechanism, the conveyance roller attached to the conveyance guide member is positioned so as to abut on a rotation roller provided in the apparatus main body.

SUMMARY

A sheet conveying device according to an aspect of the present disclosure includes a first conveyance roller, a sheet conveyance path, a second conveyance roller, and a pair of bearing portions. The first conveyance roller is provided in an apparatus main body. The sheet conveyance path has a guide surface configured to guide a sheet member in a sheet conveyance direction. The second conveyance roller is rotatably attached to the guide surface via a shaft and abuts on the first conveyance roller upon receiving a predetermined pressing force. The pair of bearing portions are provided on the guide surface in such a way as to support the shaft. Each of the bearing portions includes a concave groove portion and a bush member. The concave groove portion is formed on the guide surface such that a groove depth direction thereof intersects the guide surface. The bush member is attached to the concave groove portion so as to be slidable in the groove depth direction and support the shaft.

An image forming apparatus according to another aspect of the present disclosure includes the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
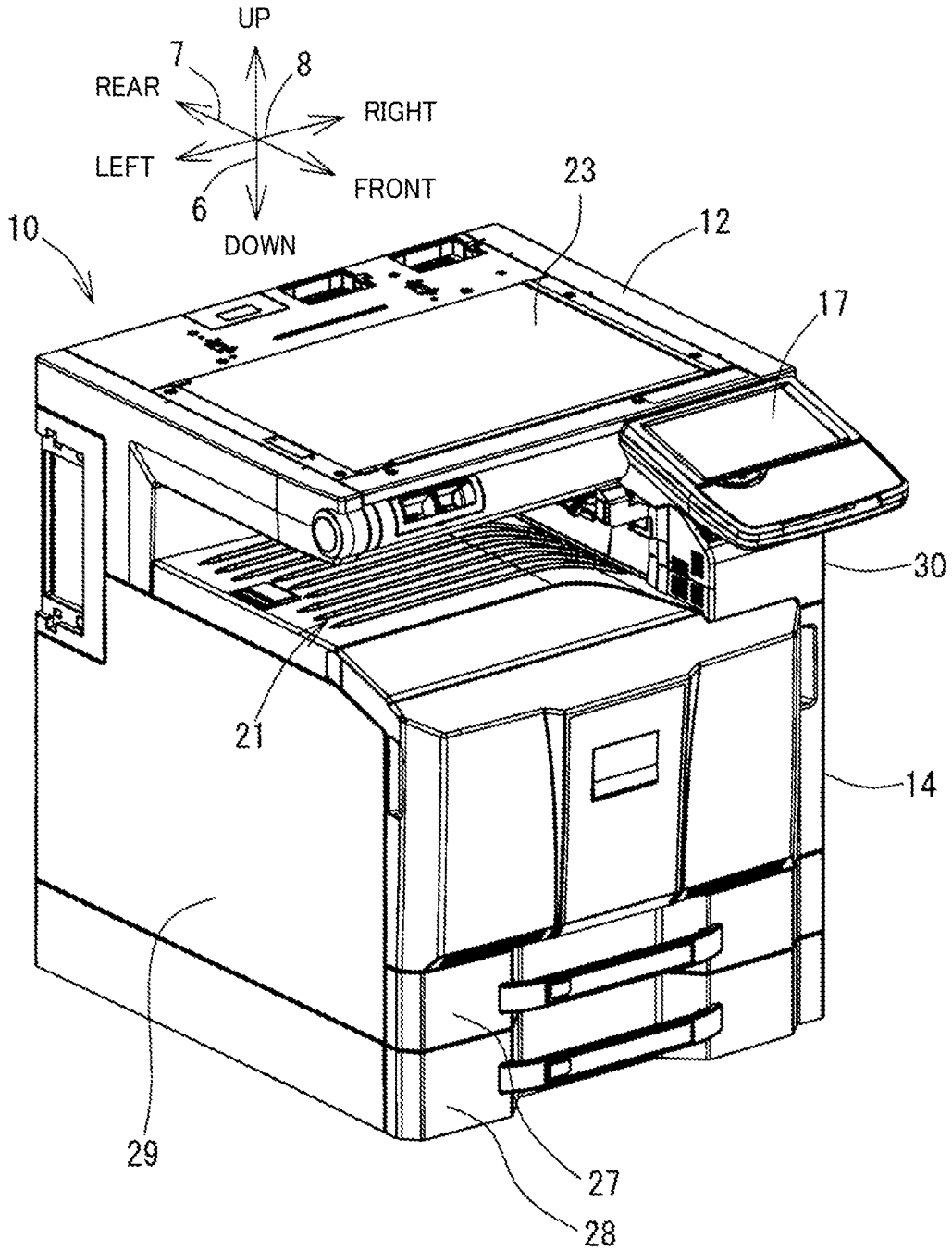
FIG. 1 is a perspective view showing a configuration of an image forming apparatus according to an embodiment of the present disclosure.

The following describes, with reference to the drawings, an image forming apparatus 10 according to an embodiment of the present disclosure, and a paper sheet conveying portion 60 (an example of the sheet conveying device of the present disclosure) provided in the image forming apparatus 10. For the sake of explanation in the following description, an up-down direction 6 is defined based on the state where the image forming apparatus 10 is installed to be usable (the state shown in FIG. 1). In addition, a front-rear direction 7 is defined on the supposition that the side on which an operation display portion 17 is provided in the above-mentioned installment state is the front side. Furthermore, a left-right direction 8 is defined based on the image forming apparatus 10 in the installment state viewed from the front side. It should be noted that the following embodiment is an example of a specific embodiment of the present disclosure and should not limit the technical scope of the present disclosure.

First, the configuration of the image forming apparatus 10 is described with reference to FIG. 1 and FIG. 2.

As shown in FIG. 1, the image forming apparatus 10 is a multifunction peripheral having a plurality of functions such as the functions of a printer, a copier, a facsimile apparatus, and a scanner. The image forming apparatus 10 forms an image of an input image on a print sheet P (an example of the sheet member of the present disclosure) by using a print material such as toner. It is noted that the image forming apparatus 10 is not limited to a multifunction peripheral, but may be a dedicated apparatus such as a printer, a copier, or a facsimile apparatus.

The image forming apparatus 10 includes an image reading portion 12 and an image forming portion 14. The image reading portion 12 performs a process of reading an image from a document sheet, and is provided in the upper portion of the image forming apparatus 10. The image forming portion 14 includes two paper sheet feed devices 27 and 28 that are arranged as two tiers in the vertical direction. The paper sheet feed device 27, the upper one of the two paper sheet feed devices, is integrally formed with a housing 29 (an example of the apparatus main body of the present disclosure) in the lowest portion of the image forming portion 14. The paper sheet feed device 28, the lower one of the two paper sheet feed devices, is extension-type and is attached to the bottom surface of the housing 29 of the image forming portion 14 as an option device. The paper sheet feed device 28 is configured to be attachable and dechable to/from the bottom surface of the housing 29. In addition, a paper sheet discharge portion 30 for discharging the print sheet P after image formation to outside is provided on the right side of the image forming portion 14.

Above the image forming portion 14, a sheet discharge space 21, into which print sheets P are discharged, is provided. The paper sheet discharge portion 30 is provided such that it couples the image forming portion 14 with the image reading portion 12, with the sheet discharge space 21 formed between the image forming portion 14 and the image reading portion 12. In the present embodiment, as shown in FIG. 1, the front side and the left side of the sheet discharge space 21 are opened. In addition, the rear side and the right side of the sheet discharge space 21 are not opened. The rear side is closed, and on the right side, the paper sheet discharge portion 30 is provided.

As shown in FIG. 1, the image reading portion 12 includes a document sheet placing table 23. In the image forming apparatus 10, after a document sheet is set on the document sheet placing table 23 and a document sheet cover 24 (see FIG. 2) is closed, a copy start instruction is input from an operation display panel 17. This causes the image reading portion 12 to start the reading operation and read the image data of the document sheet.

Figure 2:
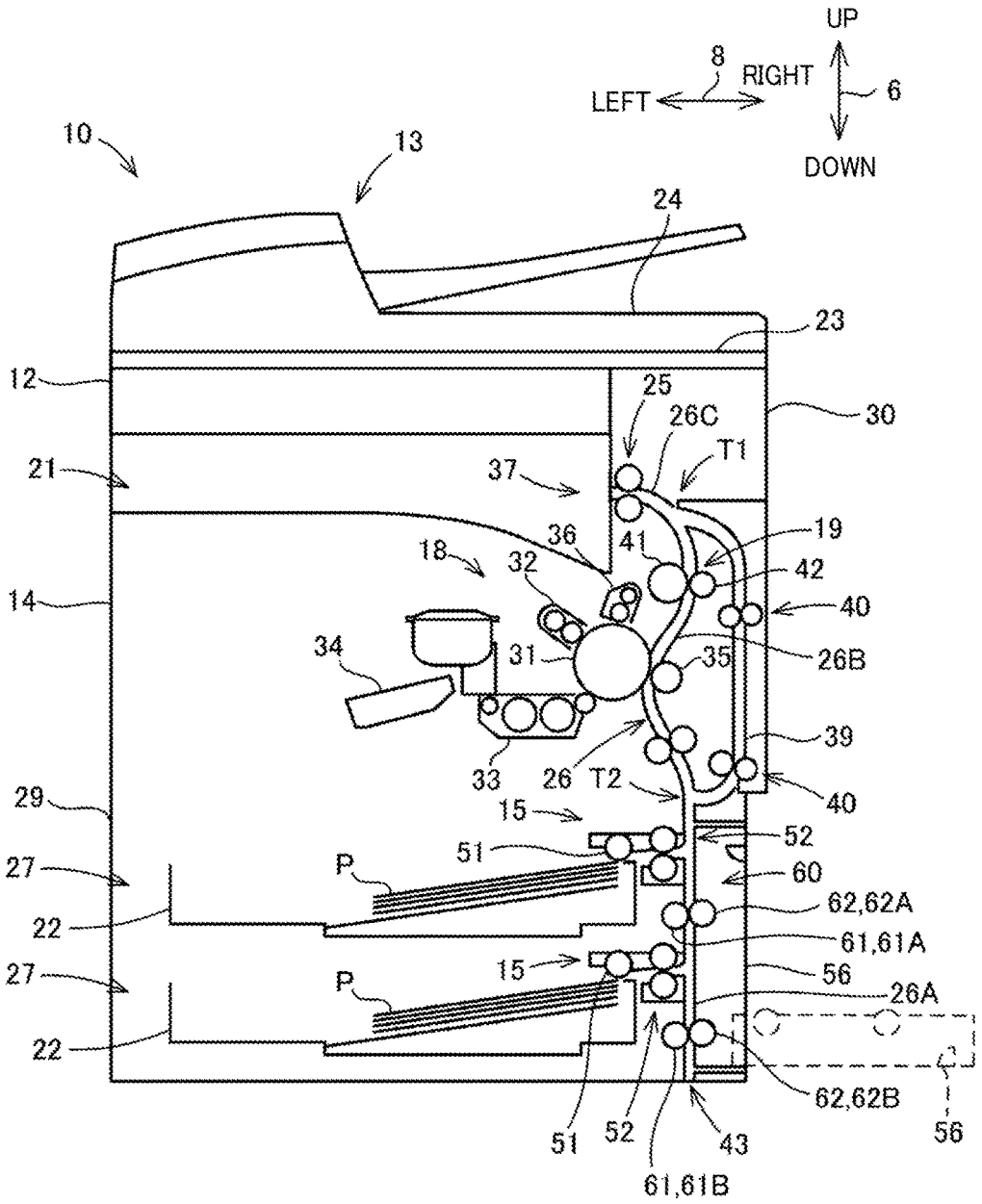
FIG. 2 is a diagram showing an internal configuration of the image forming apparatus of FIG. 1.

In addition, as shown in FIG. 2, the image reading portion 12 includes an ADF (Automatic Document Feeder) 13. The ADF 13 is provided in the document sheet cover 24. When the document sheet is conveyed to a reading position, the image of the document sheet passing the reading position is read by the image reading portion 12.

The image forming portion 14 forms an image on a print sheet P based on the image data which has been read by the image reading portion 12 or input from the outside.

As shown in FIG. 2, the image forming portion 14 mainly includes paper sheet feed devices 27 and 28, an electrophotographic image transfer portion 18, a fixing portion 19, a paper sheet conveying portion 60, a reverse conveyance path 39 in which the print sheet P is conveyed during a double-sided printing, and a control portion (not shown) for comprehensively controlling the image forming portion 14. In addition, the image forming portion 14 includes a conveying motor and a discharge motor (both not shown). These portions are provided in the housing 29 that constitutes the outer frame cover, the internal frame and the like of the image forming portion 14.

The paper sheet feed devices 27 and 28 convey the print sheet P to the conveyance path 26. Each of the paper sheet feed devices 27 and 28 includes a paper sheet storage portion 22 that is in the shape of a tray, and a conveying mechanism 15. The paper sheet storage portion 22 stores a stack of print sheets P (the print sheets P used for image formation) on which images are to be formed by the image transfer portion 18. The conveying mechanism 15 picks up and conveys, one by one, the print sheets P stored in the paper sheet storage portion 22. The conveying mechanism 15 is provided on the upper side of the right-end part of the paper sheet storage portion 22. The conveying mechanism 15 includes a feeding roller 51 and a pair of conveyance rollers 52. When an instruction for conveying a print sheet P is input to the image forming apparatus 10, the conveying motor is rotationally driven. This causes the feeding roller 51 and the pair of conveyance rollers 52 to rotate. Subsequently, a print sheet P is fed from the paper sheet storage portion 22 by the feeding roller 51, and is conveyed toward the downstream in the print sheet P conveyance direction by the pair of conveyance rollers 52.

As shown in FIG. 2, a vertical conveyance path 26 is formed in the image forming portion 14. The vertical conveyance path 26 is formed in the right-side portion of the housing 29, and extends in the up-down direction 6 along the right side. In the following, a description is provided by dividing the vertical conveyance path 26 into three sections: a first conveyance path 26A; a second conveyance path 26B; and a third conveyance path 26C. The first conveyance path 26A is a lower section of the vertical conveyance path 26, and is formed in a section extending from a paper sheet reception port 43 that is formed at the bottom of the housing 29, to a merge point T2 that is described below. The second conveyance path 26B is formed in a section extending from the merge point T2 that is near the end of the first conveyance path 26A, to a branch point T1 that is described below. The third conveyance path 26C is formed in a section extending from the branch point T1 to the sheet discharge space 21. It is noted that another paper sheet feed device (not shown) may be attached to below the paper sheet feed device 28 as an option, and the paper sheet reception port 43 is used as a reception port for receiving a print sheet fed from the optional paper sheet feed device.

On the right side of the housing 29, a cover 56 (an example of the conveyance guide member of the present disclosure) is provided, wherein the cover 56 constitutes a part of an external panel of the image forming apparatus 10. The cover 56 is provided on the right side of the paper sheet feed devices 27 and 28. The cover 56 is pivotably supported by the housing 29. In the present embodiment, the cover 56 is provided on the right side of the housing 29, and is supported so as to be opened to be in an opening attitude (the attitude represented by a dotted line in FIG. 2) for exposing the first conveyance path 26A and closed to be in a closing attitude (the attitude indicated in FIG. 2) for forming the first conveyance path 26A by closing the right side of the housing 29. The configuration of the cover 56 is described below.

The paper sheet conveying portion 60 is provided on the right side of the housing 29. The paper sheet conveying portion 60 conveys the print sheet P fed from the paper sheet feed device 28, upward along the vertical conveyance path 26. The paper sheet conveying portion 60 includes a conveyance roller 61 (an example of the first conveyance roller of the present disclosure), the above-mentioned cover 56 and a rotation roller 62 (an example of the second conveyance roller of the present disclosure).

The conveyance roller 61 (an example of the first conveyance roller of the present disclosure) is rotatably provided in the housing 29. The conveyance roller 61 is, for example, rotatably supported by an inner guide member (not shown) that constitutes an inner guide surface (left side) of the vertical conveyance path 26. It is noted that the support position of the conveyance roller 61 is not limited to the inner guide member. The conveyance roller 61 may not be supported by the inner guide member as far as it is supported so as to convey the print sheet P in the first conveyance path 26A. The conveyance roller 61 is a drive roller to which a rotational driving force is transmitted from the conveyance roller. In the present embodiment, two conveyance rollers 61 are respectively disposed above and below the pair of conveyance rollers 52. Hereinafter, the conveyance roller 61 disposed above the pair of conveyance rollers 52 is referred to as a conveyance roller 61A, the conveyance roller 61 disposed below the pair of conveyance rollers 52 is referred to as a conveyance roller 61B, and the conveyance rollers 61A and 61B are collectively referred to as the conveyance roller 61. The conveyance rollers 61A and 61B are separated from each other in the optical scanning device 6 along the first conveyance path 26A, and the outer circumferential surfaces of both are exposed to the first conveyance path 26A. The conveyance roller 61 is provided at a position that faces an inner surface 56A of the cover 56 when the cover 56 has the closing attitude. As described below, the inner surface 56A of the cover 56 is a guide surface of the first conveyance path 26A, and the rotation roller 62 is provided on the inner surface 56A. When the cover 56 has the closing attitude, the conveyance roller 61 is pressure-contacted with the rotation roller 62. The conveyance roller 61 and the rotation roller 62 constitute a pair of conveyance rollers. When the conveyance roller 61 rotates, the rotation roller 62 rotates following the rotation of the conveyance roller 61. With this configuration, the print sheet P is conveyed toward the image transfer portion 18 by the conveyance roller 61 and the rotation roller 62.

Figure 3:
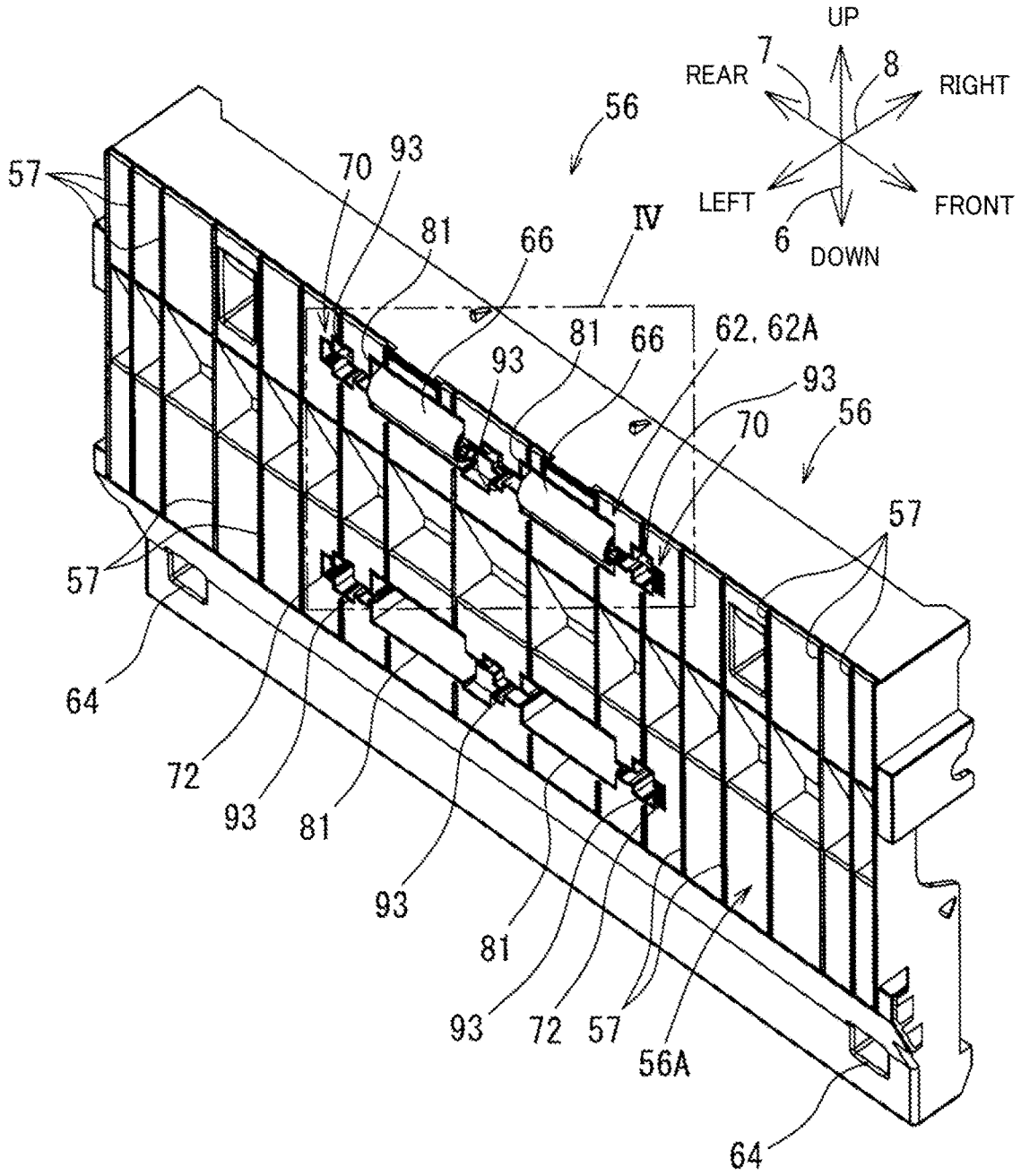
FIG. 3 is a perspective view showing a configuration of a cover included in the image forming apparatus.

The image transfer portion 18 is disposed above the paper sheet feed device 27. The image transfer portion 18 performs an image transfer process on the print sheet P conveyed from the paper sheet feed device 27 or 28. Specifically, the image transfer portion 18 transfers a toner image to the print sheet P by using a print material such as toner, based on the input image data. As shown in FIG. 3, the image transfer portion 18 includes a photoconductor drum 31, a charging portion 32, a developing portion 33, a laser scanning device 34, a transfer roller 35, and a cleaning portion 36.

The photoconductor drum 31 is provided on the left side of the second conveyance path 26B. When the image forming operation is started, the charging portion 32 charges the surface of the photoconductor drum 31 uniformly into a certain potential. In addition, the laser scanning device 34 scans the photoconductor drum 31 with a laser beam based on the image data. This results in an electrostatic latent image formed on the photoconductor drum 31. The developing portion 33 then causes the toner to adhere to the electrostatic latent image, and a toner image is formed on the photoconductor drum 31. The transfer roller 35 is provided on the right side of the second conveyance path 26B, and is disposed to face the photoconductor drum 31 across the second conveyance path 26B. When the print sheet P conveyed in the second conveyance path 26B passes through a nip portion between the transfer roller 35 and the photoconductor drum 31, the toner image is transferred onto the print sheet P by the transfer roller 35. The print sheet P with the toner image transferred thereon is conveyed in the second conveyance path 26B to the fixing portion 19 that is disposed on the downstream side of (i.e., above) the image transfer portion 18 in the conveyance direction (the sheet conveyance direction) of the print sheet P.

The fixing portion 19 fixes the toner image transferred on the print sheet P to the print sheet P by heat. The fixing portion 19 includes a heating roller 41 and a pressure roller 42. The toner is fixed to the print sheet P by the fixing portion 19.

At the end of the vertical conveyance path 26, a paper sheet discharge outlet 37, through which the print sheet P is discharged, is provided. In the vertical conveyance path 26, a branch point T1 is positioned on the downstream side of the fixing portion 19, and the third conveyance path 26C extends from the branch point T1 to the paper sheet discharge outlet 37, and is curved from the vertical direction to the horizontal direction. In the vicinity of the paper sheet discharge outlet 37, a pair of discharge rollers 25, which are configured to be rotated in dual directions by a discharge motor (not shown), are provided. The print sheet P having been passed through the fixing portion 19 and conveyed to the third conveyance path 26C is conveyed from the paper sheet discharge outlet 37 toward the sheet discharge space 21 by the pair of discharge rollers 25 that are rotated in the forward direction by the discharge motor.

When the single-sided printing is performed in the image forming portion 14, a print sheet P, with a toner image transferred to a side thereof by the image transfer portion 18, is passed through the fixing portion 19, conveyed in the third conveyance path 26C, and discharged from the paper sheet discharge outlet 37 outward.

On the other hand, when the double-sided printing is performed in the image forming portion 14, first a print sheet P with an image formed on a side thereof is passed through the fixing portion 19, and then conveyed in the third conveyance path 26C in the reverse direction into a reverse conveyance path 39. Specifically, the pair of discharge rollers 25 are stopped in the state where the front end of the print sheet P, with an image formed on a side thereof, is exposed from the paper sheet discharge outlet 37 to outside. At this time, the rear end of the print sheet P is held in the state where it is nipped by the pair of discharge rollers 25 near the paper sheet discharge outlet 37. Then, the pair of discharge rollers 25 are rotated in the reverse direction by the reverse rotation driving of the discharge motor (not shown). This causes the print sheet P to be conveyed in the third conveyance path 26C in the reverse direction. As shown in FIG. 2, the reverse conveyance path 39, branched from the third conveyance path 26C, is formed in the image forming portion 14. The reverse conveyance path 39 merges with the second conveyance path 26B at the merge point T2, which is positioned on the upstream side in the conveyance direction of the print sheet P when viewed from the image transfer portion 18 side. That is, the reverse conveyance path 39 extends from the branch point T1 to the merge point T2. The reverse conveyance path 39 is formed on the right side of the vertical conveyance path 26 in the housing 29. The reverse conveyance path 39 extends in the up-down direction 6 (vertical direction) to be approximately parallel to the vertical conveyance path 26.

The print sheet P having been conveyed from the third conveyance path 26C into the reverse conveyance path 39 is guided downward in the reverse conveyance path 39. In the reverse conveyance path 39, a pair of conveyance rollers 40 are provided. In the reverse conveyance path 39, the print sheet P is conveyed downward by the pair of conveyance rollers 40, and is sent into the vertical conveyance path 26 again at the merge point T2. The print sheet P is then conveyed in the second conveyance path 26B to the image transfer portion 18 again. In the image transfer portion 18, a side of the print sheet P, on which no image has been formed, is set to face the photoconductor drum 31 again. The print sheet P is then passed through the image transfer portion 18 and the fixing portion 19 in sequence, thereby an image is formed on the opposite side of the print sheet P on which no image has been formed. Subsequently, the print sheet P with images formed on both sides thereof is conveyed in the third conveyance path 26C by the pair of discharge rollers 25 that have been returned to the forward rotation, and then discharged into the sheet discharge space 21 from the paper sheet discharge outlet 37.

Figure 4:
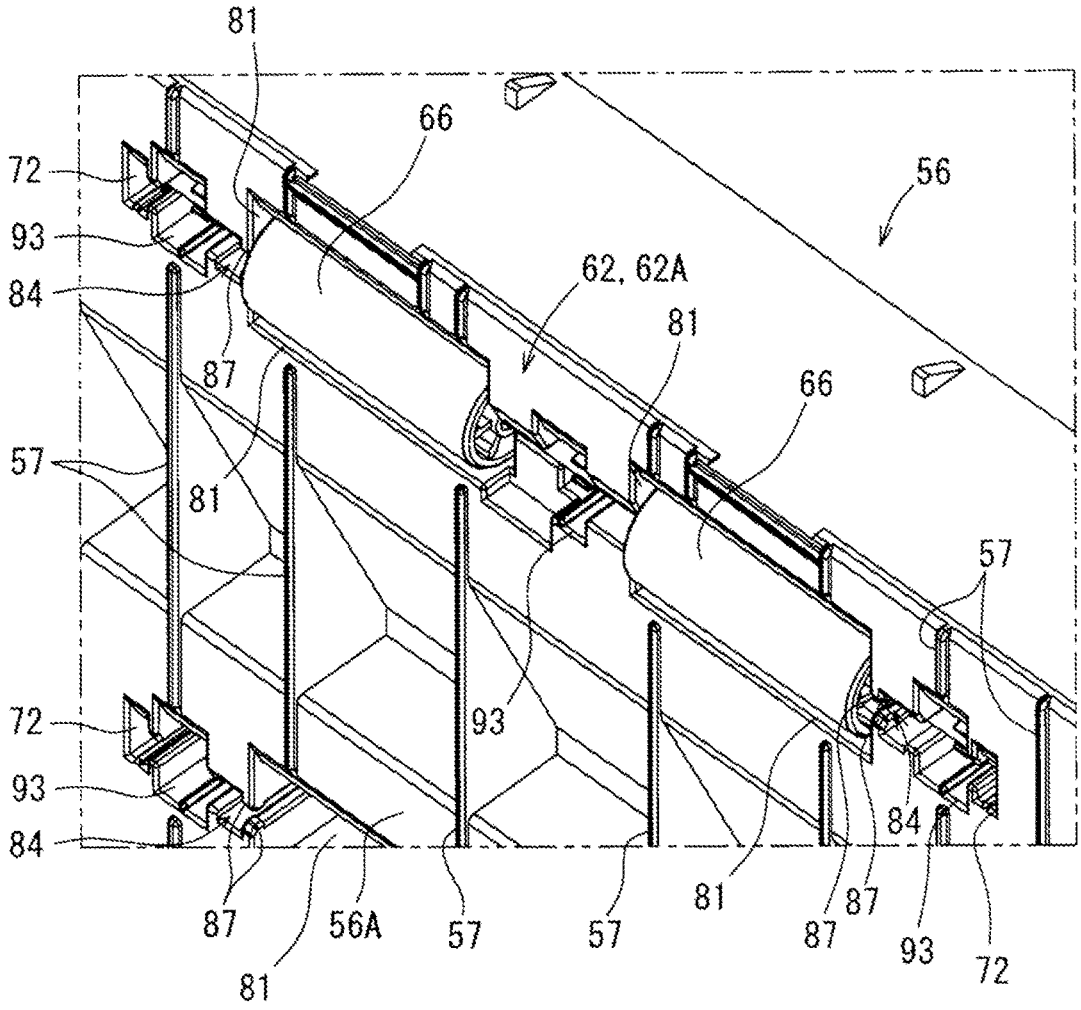
FIG. 4 is an enlarged view of a main part IV of FIG. 3.
Figure 5:
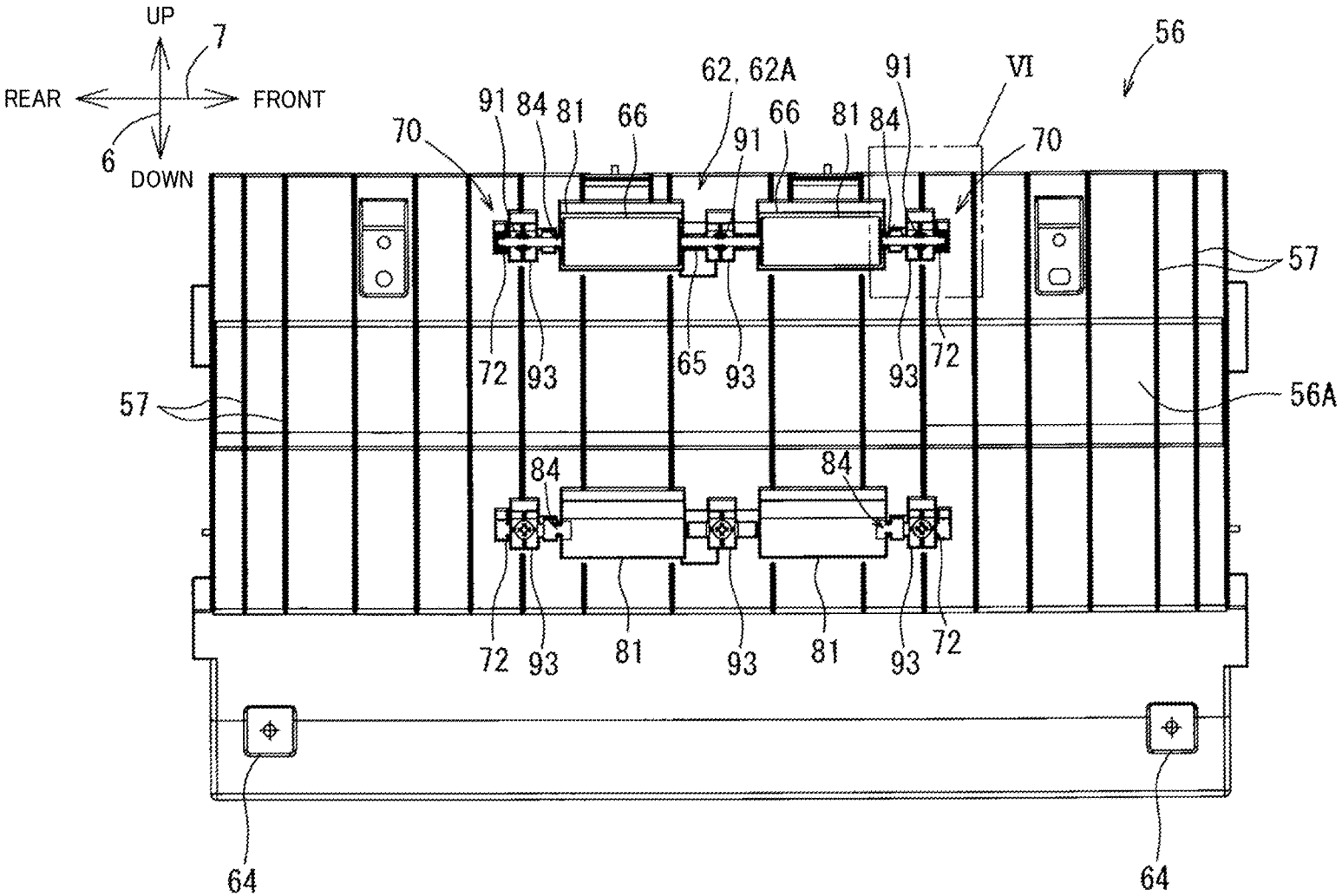
FIG. 5 is a diagram showing a guide surface of the cover.

Next, the configuration of the cover 56 is described with reference to FIG. 3 to FIG. 5. Here, FIG. 3 is a perspective view showing the configuration of the cover 56. FIG. 4 is an enlarged view of a main part IV of FIG. 3. FIG. 5 is a diagram showing the inner surface 56A of the cover 56. It is noted that, in the drawings, the up-down direction 6, front-rear direction 7 and left-right direction 8 are defined based on the state where the cover 56 is attached to the housing 29.

The cover 56 constitutes a lower portion of the right side of the housing 29, and as shown in FIG. 3, is formed in the shape of a rectangle that is long in the front-rear direction 7 (the width direction) and short in the up-down direction 6 (the height direction). The cover 56 is formed from synthetic resin (such as ABS resin). The cover 56 is supported by the housing 29 in such a way as to pivot between the opening attitude (the attitude represented by a dotted line in FIG. 2) for exposing the first conveyance path 26A and the closing attitude (the attitude indicated in FIG. 2) for forming the first conveyance path 26A. Specifically, engaging holes 64 are formed in a lower portion of the inner surface 56A of the cover 56, and when hooks (not shown) that are curved upward and provided on the housing 29 are inserted in the engaging holes 64, the cover 56 is supported so as to be pivotable between the opening attitude and the closing attitude.

When the cover 56 has the closing attitude, the inner surface 56A thereof becomes the guide surface of the first conveyance path 26A. That is, the cover 56 includes a guide surface that guides the print sheet P conveyed in the first conveyance path 26A, in the conveyance direction. As shown in FIG. 3, a plurality of guide ribs 57 (an example of the ribs of the present disclosure) extending in the up-down direction 6 are formed on the inner surface 56A. The guide ribs 57 project in a direction perpendicular to the inner surface 56A. The projection length of the guide ribs 57 is equal along the longitudinal direction thereof. In addition, all the guide ribs 57 have the same projection length. The projection end of each of the guide ribs 57 is formed in a circular arc shape. When conveyed in the first conveyance path 26A, the print sheet P is guided in the conveyance direction (upward in the up-down direction 6) while contacting the projection ends of the guide ribs 57. With this configuration where the guide ribs 57 are formed on the inner surface 56A, it is possible to reduce the contact friction that the print sheet P receives from the inner surface 56A of the cover 56 when the print sheet P is conveyed.

As shown in FIG. 2, two rotation rollers 62 are rotationally provided on the inner surface 56A of the cover 56. The rotation rollers 62 are follower rollers that rotate while contacting the corresponding conveyance rollers 61, following the rotation of the conveyance rollers 61. In the present embodiment, two rotation rollers 62 are respectively disposed on an upper portion and a lower portion of the inner surface 56A. Hereinafter, the rotation roller 62 disposed on the upper portion is referred to as a rotation roller 62A, the rotation roller 62 disposed on the lower portion is referred to as a rotation roller 62B, and the rotation rollers 62A and 62B are collectively referred to as the rotation roller 62. As shown in FIG. 3 and FIG. 4, the rotation roller 62 is composed of two rotators 66 that are each formed from synthetic resin into the shape of a cylinder. The rotators 66 are formed from synthetic resin (for example, POM) that has a smaller contact friction coefficient than the cover 56. In the present embodiment, the rotation roller 62 is rotatably supported by a shaft 65 (see FIG. 5) that is elongated and in the shape of a round bar whose cross section is a circle. That is, the two rotators 66 are rotatably supported by the shaft 65. The shaft 65 is made of a metal such as steel. It is noted that in FIG. 3 to FIG. 5, only the upper rotation roller 62A is shown. In addition, in FIG. 3 and FIG. 4, the shaft 65 is omitted.

Meanwhile, in a support mechanism that supports the shaft of the rotation roller 62 on the cover 56 that functions as a conveyance guide member, it is considered that increase of the precision in positioning the rotation roller 62 with respect to the cover 56 will produce the effect of reducing skewing of the conveyed print sheet P and vibration or sound abnormality during the rotation. However, according to conventional support mechanisms, it is configured that the rotation roller 62 is attached to the cover 56 by generating a backlash, thus the rotation roller 62 cannot be positioned with high precision with respect to the cover 56.

On the other hand, according to the present embodiment, it is configured that the rotation roller 62 can be positioned with high precision with respect to the cover 56. This reduces vibration or sound abnormality that would be generated during the conveyance of the print sheet P, and prevents the print sheet P from skewing.

Figure 6:
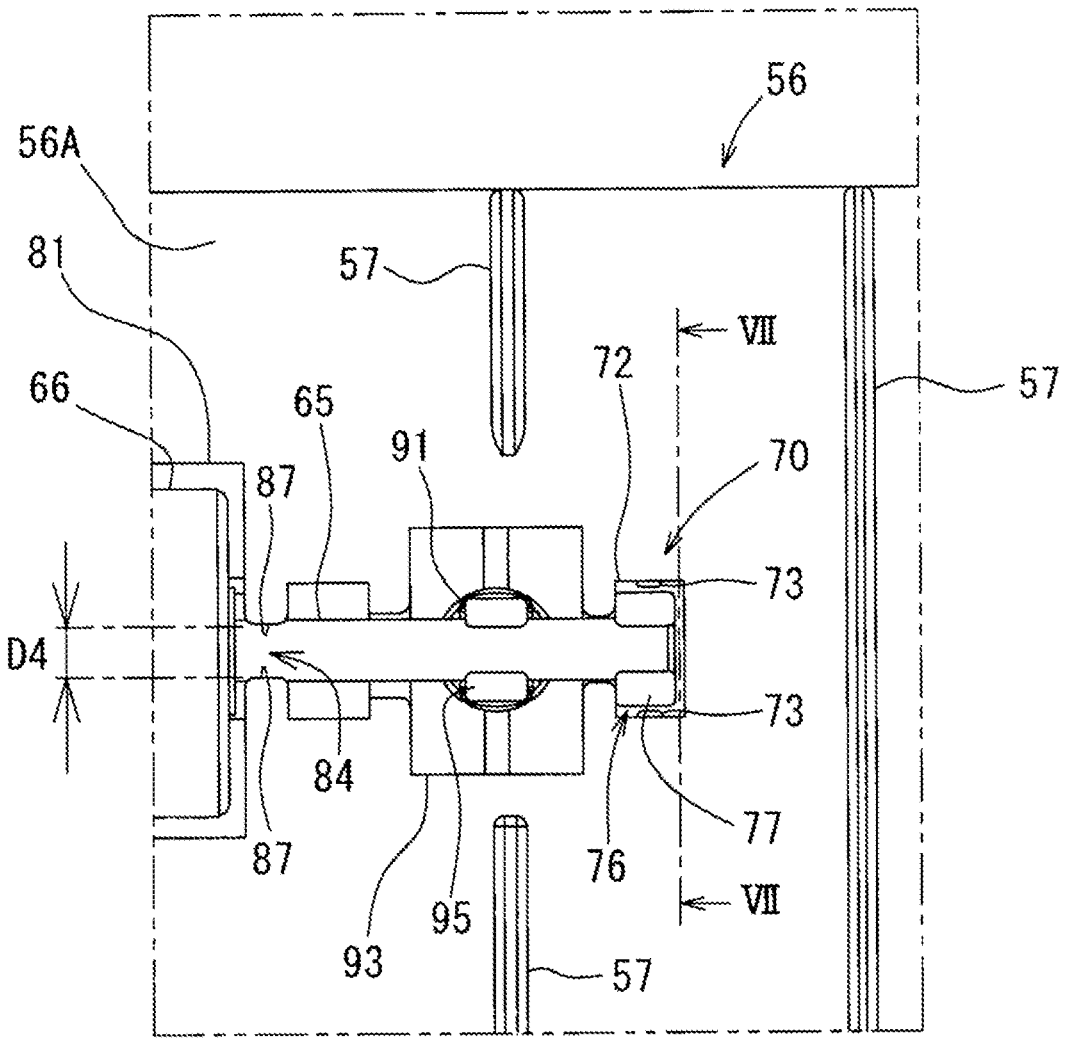
FIG. 6 is an enlarged view of a main part VI of FIG. 5.
Figure 7:
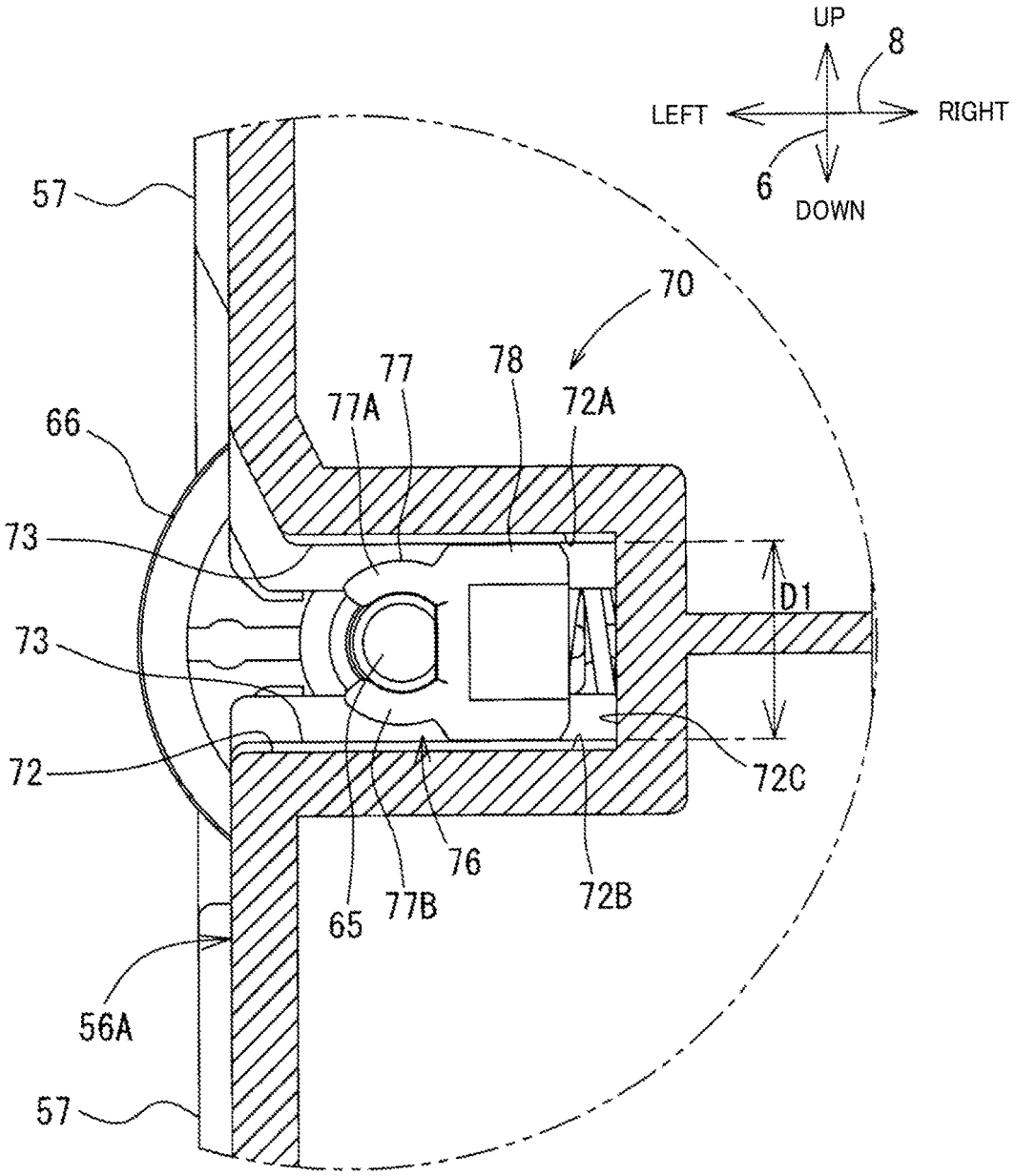
FIG. 7 is an enlarged cross section taken along line VII-VII of FIG. 6.
Figure 8:
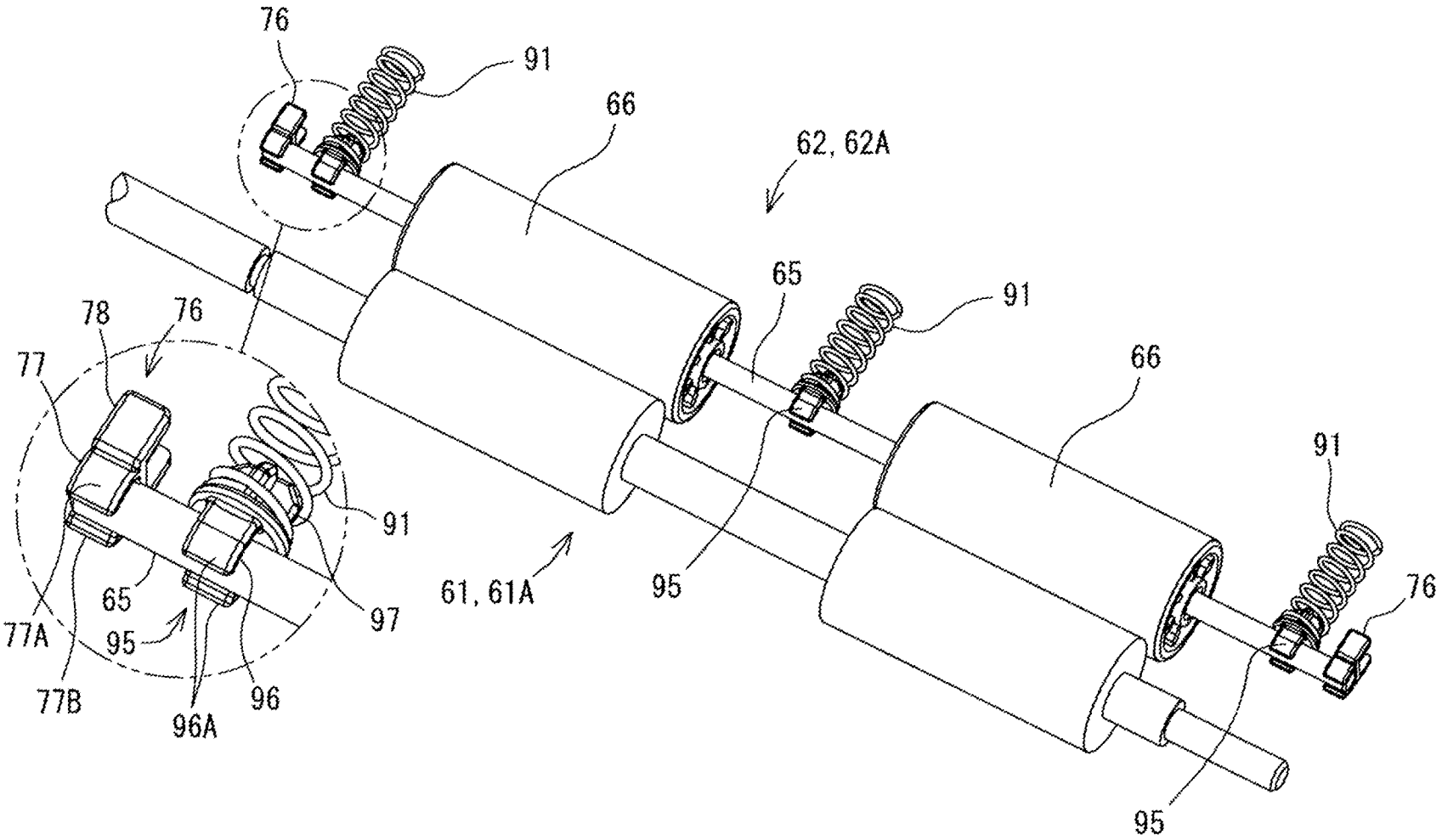
FIG. 8 is a perspective view showing a conveyance roller and a rotation roller of a paper sheet conveying portion included in the image forming apparatus.
Figure 9:
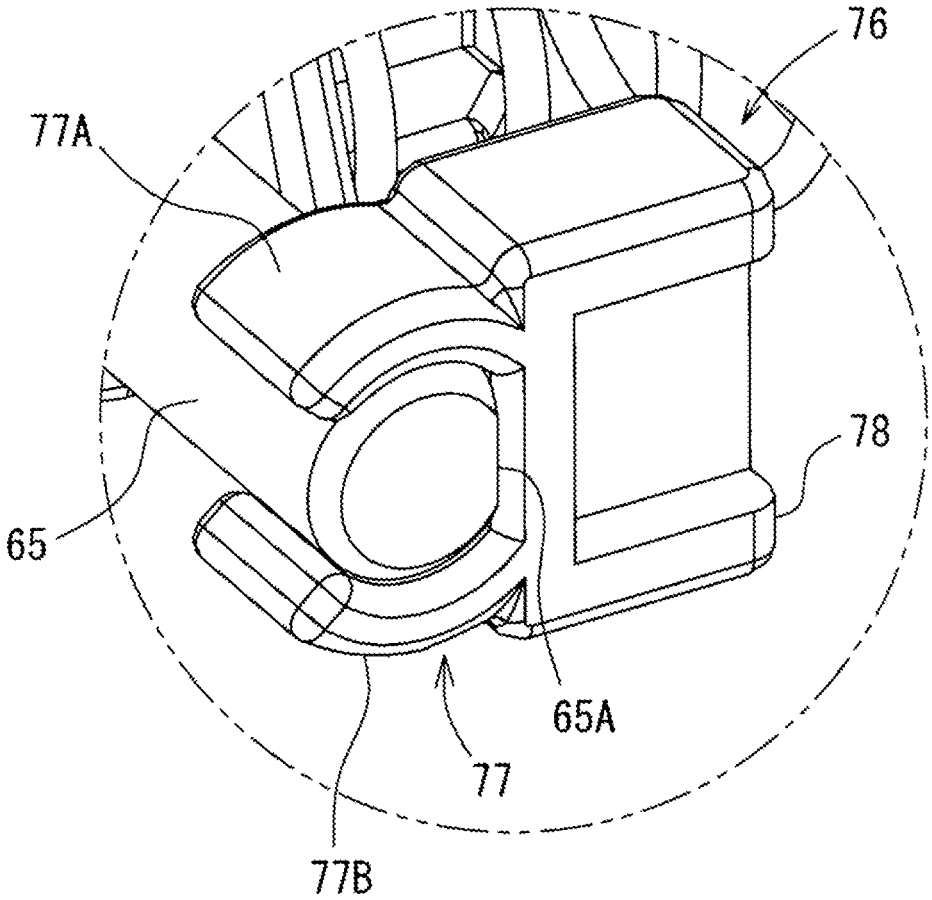
FIG. 9 is a perspective view showing a state where a shaft of the rotation roller is supported by a bush member of a bearing portion.
Figure 10:
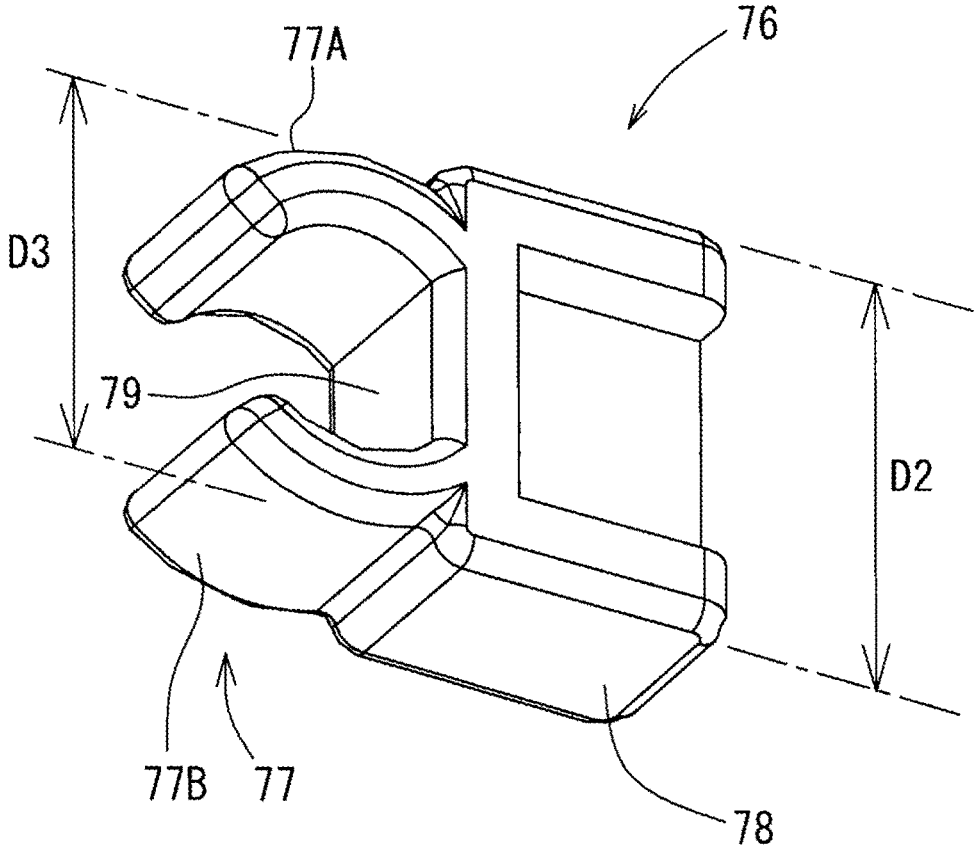
FIG. 10 is a perspective view showing the bush member.

The following describes in detail the support mechanism of the rotation roller 62A provided on the upper part of the inner surface 56A, with reference to FIG. 6 to FIG. 10. It is noted that the support mechanism of the rotation roller 62B (see FIG. 1) provided on the lower part of the inner surface 56A has the same configuration as that of the rotation roller 62A, thus description thereof is omitted. Here, FIG. 6 is an enlarged view of a main part VI of FIG. 5. FIG. 7 is an enlarged cross section taken along line VII-VII of FIG. 6. FIG. 8 is a perspective view of the conveyance roller 61 and the rotation roller 62. FIG. 9 is a partially enlarged view showing the state where the shaft 65 is supported by a bush member 76 of a bearing portion 70. FIG. 10 is a perspective view showing the bush member 76 included in the bearing portion 70.

As shown in FIG. 5, the shaft 65 is attached to the inner surface 56A of the cover 56. Specifically, bearing portions 70 that respectively support the opposite ends of the shaft 65 in the longitudinal direction are provided on the inner surface 56A. The shaft 65 is supported by the bearing portions 70. That is, the bearing portions 70 of the inner surface 56A rotatably support the two rotation rollers 62 via the shaft 65.

On the inner surface 56A of the cover 56, the two bearing portions 70 are disposed separate from each other in the width direction of the cover 56 (a direction that matches the front-rear direction 7). That is, on the inner surface 56A, a pair of bearing portions 70 are disposed separate from each other in the width direction perpendicular to the conveyance direction (upward in the up-down direction 6) of the print sheet P in the first conveyance path 26A. Furthermore, as shown in FIG. 5, the rotation roller 62 is provided between the pair of bearing portions 70.

As shown in FIG. 6 and FIG. 7, the bearing portion 70 includes a concave groove portion 72 and the bush member 76. The concave groove portion 72 is a groove formed on the inner surface 56A, and is formed in a direction (intersecting direction) that intersects the inner surface 56A. The shape of the groove of the concave groove portion 72 is a rectangle that is narrow in the width direction and is elongated in the height direction, and the inner shape of the concave groove portion 72 is approximately rectangular parallelepiped. Two projection ribs 73 are formed in the groove of the concave groove portion 72. The concave groove portion 72 includes a pair of inner wall surfaces 72A and 72B. The inner wall surfaces 72A and 72B are separated from each other in the conveyance direction of the print sheet P (a direction that matches the up-down direction 6) in the state of facing each other. The projection ribs 73 are respectively provided on the inner wall surface 72A above the concave groove portion 72, and on the inner wall surface 72B below the concave groove portion 72 (see FIG. 7). The projection ribs 73 extend in the depth direction of the concave groove portion 72 (a direction perpendicular to the plane of FIG. 6) and reach a bottom surface 72C of the concave groove portion 72 (see FIG. 7). In each of the inner wall surfaces 72A and 72B, the projection rib 73 is formed in the center thereof in the width direction. The projection length of the projection ribs 73 is equal along the longitudinal direction thereof. The projection end of each of the projection ribs 73 is formed in a circular arc shape. As a result, when a positioning portion 78 of the bush member 76 is attached to the concave groove portion 72, the inner wall surfaces 72A and 72B do not contact the positioning portion 78, but only the projection ribs 73 contact the positioning portion 78. An interval D1 between two projection ribs 73 in the up-down direction 6 (see FIG. 7) is set to be the same as an outer diameter D2 of the positioning portion 78 of the bush member 76 which is described below (see FIG. 10).

The bush member 76 is fitted in the concave groove portion 72, and supports the shaft 65 in the state of being fitted in the concave groove portion 72. The bush member 76 is formed from synthetic resin (for example, POM) that has a smaller friction coefficient than the cover 56. Since the shaft 65 is supported by the bush member 76 in the state where the bush member 76 is fitted in the concave groove portion 72, the rotation roller 62 is positioned in the up-down direction 6 on the inner surface 56A of the cover 56. In other words, on the inner surface 56A, the bush member 76 positions the rotation roller 62 together with the shaft 65, in the conveyance direction of the print sheet P (a direction that matches the up-down direction 6).

Specifically, the bush member 76 includes a first clip portion 77 and the positioning portion 78, wherein the first clip portion 77 supports the shaft 65 by gripping an end portion of the shaft 65, and the positioning portion 78 is attached to the concave groove portion 72 so as to be positioned in the conveyance direction of the print sheet P. The positioning portion 78 is disposed in the innermost part of the concave groove portion 72 in the groove depth direction. The positioning portion 78 is attached to the innermost part of the concave groove portion 72 and is supported so as to be positioned in the conveyance direction of the print sheet P. In the present embodiment, the outer diameter D2 of the positioning portion 78 (see FIG. 10) is set to be the same as the interval D1 between two projection ribs 73. With this configuration, when the positioning portion 78 is inserted in the concave groove portion 72, the positioning portion 78 is contacted and supported by the projection ribs 73 such that it can slide toward the depth of the concave groove portion 72. That is, when the positioning portion 78 of the bush member 76 is attached to the concave groove portion 72, the positioning portion 78 slidably contacts the projection ribs 73. In this way, since the projection ribs 73 slidably support the positioning portion 78, it is possible to reduce the sliding resistance of the positioning portion 78. In addition, when the bush member 76 is inserted in the concave groove portion 72, the positioning portion 78 is disposed in the innermost part of the concave groove portion 72 in the state where the positioning portion 78 is in contact with the projection ribs 73. This enables the positioning portion 78 to be attached to the innermost part of the concave groove portion 72 without a backlash in the conveyance direction of the print sheet P. It is noted that although in the present embodiment, the outer diameter D2 of the positioning portion 78 is set to be the same as the interval D1 between two projection ribs 73, the outer diameter D2 and the interval D1 may be different sizes as far as the projection ribs 73 can slidably support the positioning portion 78.

The first clip portion 77 is disposed in the front side of the concave groove portion 72 in the groove depth direction. As shown in FIG. 10, the first clip portion 77 includes a pair of arm portions 77A and 77B that extend from the positioning portion 78, wherein the arm portion 77A is above and the arm portion 77B is below. Each of the arm portions 77A and 77B has an arc shape. The shaft 65 is passed through a space surrounded by the arm portions 77A and 77B. An interval between the lower surface of the arm portion 77A and the upper surface of the arm portion 77B is set to be smaller than the outer diameter of the shaft 65. As a result, when the shaft 65 is passed through between the arm portions 77A and 77B, the arm portions 77A and 77B are bent in directions away from each other, allowing the shaft 65 to pass through therebetween, and hold the outer circumferential surface of the shaft 65 by the restoring force of the arm portions 77A and 77B.

Since, as described above, the bush member 76 includes the arm portions 77A and 77B, two bush members 76 can respectively be attached to opposite ends of the shaft 65 in the state where the bush members 76 are oriented to the same direction, as shown in FIG. 8. At this time, since the arm portions 77A and 77B are holding the shaft 65 by the restoring force thereof, the bush members 76 hold the shaft 65 in the state where the bush members 76 are oriented to the same direction, without being rotated around the axis of the shaft 65. As a result, the shaft 65, together with the bush members 76, can be easily attached to the inner surface 56A of the cover 56.

An outer diameter D3 of the first clip portion 77 in the height direction (see FIG. 10) is set to be smaller than the interval D1 between two projection ribs 73 and the outer diameter D2 of the positioning portion 78. As a result, in the state where the bush member 76 is attached to the concave groove portion 72, the first clip portion 77 is not contacting the projection ribs 73.

As shown in FIG. 9, a flat surface 65A is formed on a part of the outer circumferential surface (supported portion) of the shaft 65 that is supported by the first clip portion 77. Specifically, the flat surfaces 65A are formed on the circumferential surface of the shaft 65 respectively at opposite ends thereof. The length of the flat surface 65A in the up-down direction 6 is smaller than the outer diameter of the shaft 65. As a result, the end portions of the shaft 65 are in the shape of a capital letter D (a D-cut shape) in a cross section. In the present embodiment, the first clip portion 77 supports an end portion of the shaft 65 unrotatably. Specifically, as shown in FIG. 10, a support surface 79 is formed in the first clip portion 77 at a position corresponding to the flat surface 65A of the shaft 65 such that the support surface 79 contacts the flat surface 65A by a surface-on-surface contact. As a result, when an end portion of the shaft 65 is inserted in the first clip portion 77 such that the flat surface 65A faces the support surface 79, and the flat surface 65A contacts the support surface 79 by a surface-on-surface contact, the shaft 65 is supported by the first clip portion 77 in the state where the rotation of the shaft 65 around its axis is restricted. Accordingly, even if a rotation friction is generated in the rotation direction of the shaft 65 around its axis when it comes into contact with the rotation roller 62 that is in rotation, the shaft 65 does not rotate around its axis, but is held by the first clip portion 77 in a stationary state.

As shown in FIG. 3 to FIG. 5, attachment concave portions 81 are formed on the inner surface 56A. The attachment concave portions 81 are provided such that the rotators 66 of the rotation rollers 62 are embedded therein. The attachment concave portions 81 are formed in a semi-cylindrical shape and are recessed in a direction perpendicular to the inner surface 56A. The rotators 66 are embedded approximately by half in the attachment concave portions 81 in the state where the shaft 65 of the rotation roller 62 is supported by the bearing portions 70. In the present embodiment, two attachment concave portions 81 are formed on the inner surface 56A in correspondence with two rotators 66. The two attachment concave portions 81 are formed between two bearing portions 70 at positions separated in the width direction.

As shown in FIG. 6, pass-through grooves 84 through which the shaft 65 is passed through are formed on the inner surface 56A. The pass-through grooves 84 are each formed between the concave groove portion 72 of the bearing portion 70 and the attachment concave portion 81. The shaft 65 is passed through the pass-through grooves 84 in the state where the shaft 65 is supported by the bearing portions 70. In the present embodiment, as shown in FIG. 7, the shaft 65 is supported by the bush member 76 in the state where the bush member 76 is completely embedded in the concave groove portion 72. As a result, the above-mentioned pass-through grooves 84 and attachment concave portions 81 and the like are formed on the inner surface 56A, and the shaft 65 is passed through the pass-through grooves 84 so as to be supported by the first clip portions 77, and the rotators 66 are embedded in the attachment concave portions 81.

In addition, a pair of projection portions 87 that are separated from each other in the up-down direction 6, are formed respectively at groove edges of the pass-through groove 84. The pair of projection portions 87 project from the groove edges of the pass-through groove 84 toward inside of the pass-through groove 84. Specifically, the projection portions 87 are respectively provided on the upper and lower groove edges of the pass-through groove 84 so as to face each other and project toward each other. An interval D4 (see FIG. 6) between the pair of projection portions 87 is set to be smaller than the outer diameter of the shaft 65. When the shaft 65 is fitted in the pass-through groove 84 from the groove edge side, the shaft 65 is pressed toward the depth of the pass-through groove 84, then the projection portions 87 are bent in directions away from each other, and the interval between the groove edges of the pass-through groove 84 is increased. Subsequently, when the shaft 65 is inserted in the innermost part of the pass-through groove 84, the bended projection portions 87 return to the original positions. This makes it difficult for the shaft 65 to slip out from the pass-through groove 84. That is, for the pass-through grooves 84, the projection portions 87 function as a stopper of the shaft 65 that has been passed through the pass-through grooves 84.

As shown in FIG. 6, coil springs 91 (an example of the elastic member of the present disclosure) are provided on the cover 56. In addition, storage concave portions 93 for supporting the coil springs 91 are formed on the inner surface 56A of the cover 56. Furthermore, holders 95 for holding the coil springs 91 and the shaft 65 are provided on the cover 56.

As shown in FIG. 8, the coil springs 91 provide the shaft 65 supported by the bearing portions 70 with a biasing force of the spring force, in a direction away from the inner surface 56A. That is, the coil springs 91 elastically bias the shaft 65. Here, FIG. 8 is a perspective view of the rotation roller 62 and the conveyance roller 61 extracted for the sake of explanation, and the cover 56 and the like are omitted in the drawing. In the present embodiment, three coil springs 91 are provided on the cover 56. Approximately the opposite ends and the center of the shaft 65 are biased by the three coil springs 91. As described below, the coil springs 91 are provided between the shaft 65 and the storage concave portions 93 in a compressed state. As a result, the restoring force of the coil springs 91 is applied to the shaft 65 as the biasing force. With the provision of the coil springs 91, when the cover 56 has the closing attitude and the rotation rollers 62 are contacting the conveyance rollers 61, the pressing force of the coil springs 91 is applied to the conveyance rollers 61. The coil springs 91 are merely an example of the elastic member, but any other member is applicable as far as the biasing force is applied to the shaft 65.

The storage concave portions 93 are grooves of a concave shape formed on the inner surface 56A. As shown in FIG. 5, three storage concave portions 93 are formed on the inner surface 56A. The storage concave portions 93 are formed at positions that correspond to the opposite ends and the center of the shaft 65. An end of each coil spring 91 is stored in a corresponding storage concave portion 93 such that the coil springs 91 are supported by the storage concave portions 93. Specifically, for example, a projection (not shown) in a shape of a cross is formed on the bottom surface of each storage concave portion 93, and the projection is fitted in an inner hole formed in an end of the coil spring 91, thereby the end of the coil spring 91 is supported by the storage concave portion 93.

The holders 95 connect the shaft 65 with the coil springs 91. As shown in FIG. 8, three holders 95 are provided respectively in correspondence with the coil springs 91. Each holder 95 includes a second clip portion 96 and an engaging portion 97, wherein the second clip portion 96 supports the shaft 65 by gripping it, and the engaging portion 97 holds the other end (the end opposite to the storage concave portion 93) of the coil spring 91. The second clip portion 96 is fixed to the end of the coil spring 91 via the engaging portion 97. The second clip portion 96 includes a pair of curved arm portions 96A that are configured to hold the shaft 65. The shaft 65 is passed through a space surrounded by the arm portions 96A so as to be supported by the arm portions 96A. The arm portions 96A are formed in the same shape as the arm portions 77A and 77B of the bush member 76. That is, an interval between the arm portions 96A is set to be smaller than the outer diameter of the shaft 65. As a result, when the shaft 65 is passed through between the arm portions 96A, the arm portions 96A are bent in directions away from each other, allowing the shaft 65 to pass through therebetween, and hold the outer circumferential surface of the shaft 65 by the restoring force of the arm portions 96A.

The engaging portion 97 is a projection in a shape of a cross. The engaging portion 97 is fitted in an inner hole at an end of the coil spring 91 so as to be engaged with the end of the coil spring 91. When the engaging portion 97 is fitted in the inner hole of the coil spring 91, the engaging portion 97 holds the end of the coil spring 91. The inner hole of the coil spring 91 is formed to be slightly smaller in size than the outer diameter of the engaging portion 97 so that the engaging portion 97 cannot easily slip out of the inner hole. With this configuration, the engaging portion 97 is fixed to the end of the coil spring 91 so as not to be removed easily therefrom.

With the provision of the holders 95 configured as described above, a plurality of coil springs 91 in the compressed state can be easily disposed between the shaft 65 and the storage concave portions 93 in the state where the shaft 65 is supported by the bearing portions 70. In addition, as shown in FIG. 8, the coil springs 91 can be held while being oriented to the same direction as the bush members 76 with respect to the shaft 65. As a result, the shaft 65, together with the bush members 76 and the coil springs 91, can be easily attached to the inner surface 56A of the cover 56.

With the above-described configuration of the paper sheet conveying portion 60, when the shaft 65 of the rotation roller 62 is supported by the bush members 76, the shaft 65 and the rotation roller 62 are positioned in the up-down direction 6 with high precision with respect to the inner surface 56A of the cover 56. With this configuration, a skew conveyance due to a positioning failure does not occur when the print sheet P is conveyed upward in the first conveyance path 26A. In addition, since the bush member 76 is positioned in the up-down direction 6 with respect to the inner surface 56A of the cover 56, the vibration that would occur during the conveyance of the print sheet P is reduced, and a drive sound that would be caused by the vibration is reduced.

In the above-described embodiment, as an example of the conveyance guide member constituting a part of the first conveyance path 26A, the cover 56 that can open and close the right side of the housing 29 is described. However, the present disclosure is not limited to this configuration. The conveyance guide member may be fixed to the housing 29 as far as it has a guide surface that constitutes a part of the first conveyance path 26A.

In addition, in the above-described embodiment, by way of example, the cover 56 that constitutes a part of the first conveyance path 26A is described. However, the present disclosure is not limited to this configuration. For example, instead of the cover 56 that is pivotably supported by the housing 29, a conveyance guide member may be provided which can be attached to a side surface of the housing 29 in a detachable manner, and forms a part of the first conveyance path 26A in the state of being attached to the side surface of the housing 29. Furthermore, the present disclosure is applicable to a configuration where a cover member or a conveyance guide member corresponding to the reverse conveyance path 39 is provided on a side of the housing 29, and a support mechanism supporting a rotation roller that is one of the pair of conveyance rollers 40, is provided on the cover member or the conveyance guide member.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a first conveyance roller provided in an apparatus main body;

a sheet conveyance path having a guide surface configured to guide a sheet member in a sheet conveyance direction;

a second conveyance roller rotatably attached to the guide surface via a shaft and configured to abut on the first conveyance roller upon receiving a predetermined pressing force;

a pair of bearing portions provided on the guide surface in such a way as to support the shaft, each of the bearing portions including:

a concave groove portion formed on the guide surface such that a groove depth direction thereof intersects the guide surface; and a bush member attached to the concave groove portion so as to be slidable in the groove depth direction and support the shaft;

an attachment concave portion formed on the guide surface between the bearing portions in a direction extending along the shaft, such that a part of the second conveyance roller is embedded therein; and a pass-through groove formed between the concave groove portion of one of the bearing portions and the attachment concave portion such that the shaft is passed therethrough, wherein the shaft passed through the pass-through groove is supported by the bush member in a state where the bush member is embedded in the concave groove portion, the pass-through groove includes a pair of projection portions that project respectively from a pair of groove edges that face each other in the sheet conveyance direction, toward inside of the pass-through groove, and the pair of projection portions function as a stopper of the shaft passed through the pass-through groove.

2. The sheet conveying device according to claim 1, wherein the concave groove portion includes:

a bottom surface; and a pair of inner wall surfaces that are separated from each other in the sheet conveyance direction and face each other, and the bush member includes:

a first clip portion configured to support the shaft; and a positioning portion disposed more on a side of the bottom surface of the concave groove portion than the first clip portion and configured to slide along the pair of inner wall surfaces of the concave groove portion so as to be positioned in the sheed conveyance direction.

3. The sheet conveying device according to claim 1, wherein the concave groove portion includes:

a bottom surface;

a pair of inner wall surfaces that are separated from each other in the sheet conveyance direction and face each other; and a rib formed on each of the pair of inner wall surfaces to extend in a direction in which the bush member slides, and the bush member includes:

a first clip portion configured to support the shaft; and a positioning portion disposed more on a side of the bottom surface of the concave groove portion than the first clip portion and configured to slide along the ribs of the pair of inner wall surfaces of the concave groove portion so as to be positioned in the sheet conveyance direction.

4. The sheet conveying device according to claim 2, wherein the first clip portion includes a pair of arm portions that each extend from the positioning portion to form an arc shape, the pair of arm portions are disposed to face each other in the sheet conveyance direction, and the shaft is fitted in between the pair of arm portions so as to be supported thereby.

5. The sheet conveying device according to claim 2, wherein a flat surface is formed on a part of an outer circumferential surface of the shaft that is supported by the first clip portion, and a support surface is formed in the first clip portion such that the support surface contacts the flat surface by a surface-on-surface contact, and the shaft is supported in an unrotatable state.

6. The sheet conveying device according to claim 1 further comprising:

a cover member provided on a side of the apparatus main body and including the guide surface of the sheet conveyance path formed in the apparatus main body, the cover member being opened to be in an opening attitude for exposing the sheet conveyance path and closed to be in a closing attitude for forming the sheet conveyance path by closing the side of the apparatus main body.

7. An image forming apparatus comprising:

the sheet conveying device according to claim 1.

8. A sheet conveying device comprising:

a first conveyance roller provided in an apparatus main body;

a sheet conveyance path having a guide surface configured to guide a sheet member in a sheet conveyance direction;

a second conveyance roller rotatably attached to the guide surface via a shaft and configured to abut on the first conveyance roller upon receiving a predetermined pressing force;

a pair of bearing portions provided on the guide surface in such a way as to support the shaft, each of the bearing portions including:

a concave groove portion formed on the guide surface such that a groove depth direction thereof intersects the guide surface; and a bush member attached to the concave groove portion so as to be slidable in the groove depth direction and support the shaft;

an attachment concave portion formed on the guide surface between the bearing portions in a direction extending along the shaft, such that a part of the second conveyance roller is embedded therein;

a pass-through groove formed between the concave groove portion of one of the bearing portions and the attachment concave portion such that the shaft is passed therethrough;

an elastic member disposed on the guide surface between one of the bearing portions and the attachment concave portion and configured to elastically bias the shaft in a direction in which the second conveyance roller projects from the guide surface;

a second clip portion fixed to an end of the elastic member so as to be attached to the shaft in a detachable manner; and a storage concave portion formed on the guide surface and storing the elastic member, wherein the shaft passed through the pass-through groove is supported by the bush member in a state where the bush member is embedded in the concave groove portion.

* * * * *